US009853366B2

(12) United States Patent
Nickel et al.

(10) Patent No.: US 9,853,366 B2
(45) Date of Patent: Dec. 26, 2017

(54) CRIMP CONTACT WITH IMPROVED CONTACTING AND CRIMP CONNECTION

(71) Applicant: TE Connectivity Germany GmbH, Bensheim (DE)

(72) Inventors: Jens Nickel, Weinheim (DE); Uwe Blummel, Hemsbach (DE); Helge Schmidt, Speyer (DE); Volker Seipel, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/367,647

(22) Filed: Dec. 2, 2016

(65) Prior Publication Data

US 2017/0162954 A1 Jun. 8, 2017

(30) Foreign Application Priority Data

Dec. 3, 2015 (DE) ..... 10 2015 224 219

(51) Int. Cl.
*H01R 4/10* (2006.01)
*H01R 4/18* (2006.01)

(52) U.S. Cl.
CPC ..... *H01R 4/184* (2013.01)

(58) Field of Classification Search
CPC ..... H01R 13/115; H01R 13/111; H01R 4/185; H01R 4/183; H01R 4/20
USPC ..... 439/850, 851, 877–879
See application file for complete search history.

(56) References Cited

U.S. PATENT DOCUMENTS

| | | | | |
|---|---|---|---|---|
| 4,708,416 | A * | 11/1987 | Awano | H01R 13/11 439/851 |
| 6,334,798 | B1 * | 1/2002 | Ushijima | H01R 4/187 439/203 |
| 7,121,903 | B2 * | 10/2006 | Sakaguchi | H01R 4/185 439/877 |
| 7,494,388 | B2 * | 2/2009 | Kakuta | H01R 4/185 439/877 |
| 7,828,611 | B2 * | 11/2010 | Nakamura | H01R 4/185 439/877 |
| 7,867,027 | B2 * | 1/2011 | Sakaguchi | H01R 4/184 439/585 |

(Continued)

FOREIGN PATENT DOCUMENTS

| | | |
|---|---|---|
| EP | 2045879 A1 | 4/2009 |
| JP | 2004055331 A | 2/2004 |
| JP | 2009123622 A | 6/2009 |

OTHER PUBLICATIONS

German Office Action, dated Jun. 3, 2016, 7 pages.
Abstract of JP2004055331, dated Feb. 19, 2004, 2 pages.
Abstract of JP2009123622, dated Jun. 4, 2009, 2 pages.

*Primary Examiner* — Thanh Tam Le
(74) *Attorney, Agent, or Firm* — Barley Snyder

(57) ABSTRACT

A crimp contact is disclosed. The crimp contact has a receptacle extending in a longitudinal direction up to a receptacle end, a crimp section extending along the receptacle and beyond the receptacle end to a front end, and a wing extending from the crimp section between the receptacle end and the front end transversely to the longitudinal direction, the wing having a conductor displacing member overlapping the receptacle in the longitudinal direction. The receptacle receives a conductor in the longitudinal direction. The crimp section encloses the conductor subsequent to crimping.

21 Claims, 7 Drawing Sheets

(56) References Cited

U.S. PATENT DOCUMENTS

| | | | | |
|---|---|---|---|---|
| 7,987,592 | B2 * | 8/2011 | Good | H01R 4/184 219/247 |
| 8,210,884 | B2 * | 7/2012 | Corman | H01R 4/185 439/877 |
| 9,039,467 | B2 * | 5/2015 | Seipel | H01R 4/185 439/877 |
| 9,601,839 | B2 * | 3/2017 | Sakaguchi | H01R 4/185 |
| 2010/0035487 | A1 | 2/2010 | Nakagawa et al. | |
| 2010/0144217 | A1 | 6/2010 | Kumakura et al. | |
| 2010/0230160 | A1 | 9/2010 | Ono et al. | |
| 2012/0094551 | A1 | 4/2012 | Corman et al. | |

* cited by examiner

CRIMP CONTACT WITH IMPROVED CONTACTING AND CRIMP CONNECTION

CROSS-REFERENCE TO RELATED APPLICATION

This application claims the benefit of the filing date under 35 U.S.C. §119(a)-(d) of German Patent Application No. 102015224219.6, filed on Dec. 3, 2015.

FIELD OF THE INVENTION

The present invention relates to a crimp contact, and more particularly, to a crimp contact for crimping a conductor.

BACKGROUND

Crimp contacts having two crimp sections arranged on opposite sides of a crimp base are known in the art. An end of a conductor is positioned between the crimp sections and over the crimp base, and the crimp sections are crimped around the end of the conductor, for example, with crimping pliers or a crimping device. The conductor is thus connected both mechanically and electrically to the crimp contact.

Applications of crimp contacts in the mobile field, such as in automobile construction, require weight savings which are made possible by using, for example, aluminum conductor wires. Aluminum, however, forms insulative aluminum oxide from contact with ambient air, and consequently, electrically contacting an aluminum wire is difficult. It is therefore necessary to pierce through the aluminum oxide layer when electrically contacting an aluminum wire for the first time and advantageous to protect the aluminum wire from environmental influences in the case of further use.

Known crimp contacts generally consist of copper, and since aluminum and copper have different standard potentials, it is necessary to impede the ingress of any electrically conductive liquids; even liquids with the slightest impurities. By impeding ingress, it can be ensured that the aluminum does not electrochemically decompose due to the difference in electrical potential. In addition, through such a protection of the aluminum wires, hermetic sealing from ambient air may likewise be possible, which impedes a (renewed) oxidation of the aluminum.

In the prior art, such protection for the aluminum is addressed through self-protecting crimp connections. These known crimp connections are formed by crimp contacts having an insulation crimp, a conductor crimp, and wings or front protection lugs, wherein, in the crimping process, the wings or front protection lugs are crimped such that they block the access to the crimp sleeve. In addition, a self-protecting crimp has sealing agent repositories through which, during crimping, a sealing agent is made available which fills gaps still remaining in the crimped front protection crimp, in the crimped conductor crimp (i.e. between the conductor crimp and the aluminum conductor) and in the insulation crimp (i.e. between the insulation of the aluminum conductor and the insulation crimp) and thus prevents ingress of electrically conductive and/or corrosive liquids along with ambient air.

In the crimping process, the wings are curved in the direction of the receptacle of the conductor so that the wings which are opposite one another touch over an axis of symmetry of the crimp contact which extends in a longitudinal direction and come closer to the crimp base. Since the aluminum oxide layer is formed at all outer surfaces of the aluminum conductor prior to crimping, piercing through this aluminum oxide layer is accomplished during crimping through mechanical contact with the crimp contact; through serrations or indentations formed on the crimp contact Single strands of the aluminum conductor situated on the inside of the conductor are, however, sometimes not sufficiently mechanically stressed during crimping in order to pierce through the aluminum oxide layer. These single strands situated on the inside are no longer available for the conduction of electrical current due to the aluminum oxide layer formed around them, and the resistance of the aluminum conductor used is increased.

A plug connector 2 according to the prior art comprising a crimp contact 1, a contact member 5 extending in a longitudinal direction 7, and a bearing strip 11 is shown in FIGS. 1-4.

The crimp contact 1 comprises two wings 13 and two crimp sections 15, the crimp sections 15 comprising an insulation crimp 17, a conductor crimp 19 and a front protection crimp 21. The insulation crimp 17, conductor crimp 19, and front protection crimp 21 each extend from one crimp section 15 via a crimp base 23 to a crimp section 15 situated opposite, so that a continuous sleeve, the crimp sleeve 3, is formed. The crimp sleeve 3 encloses a receptacle 24 in which a conductor 43 (not shown) can be received. The crimp sleeve 3 is linked to a bearing strip 11 via a linking bar 9. The linking bar 9, the bearing strip 11, and the contact member 5 are shown purely by way of example. Serrations 25, or indentations, are formed in the conductor crimp 19, and a sealing agent repository 27 is formed in the front protection crimp 21.

The crimp contact 1 is shown in a pre-crimped state 35 in FIG. 2. The front protection crimp 21 is integrally formed with the conductor crimp 19, wherein, in the depiction shown in FIG. 2, the wing 13 separates both crimp regions 19, 21 from one another. On an underside 29 of the crimp contact 1, a step 31 can be seen which distinguishes a transition region 33 between the conductor crimp 19 and the insulation crimp 17. The receptacle 24 for the conductor 43 extends over the conductor crimp 19 and the insulation crimp 17. The conductor insulation (not shown) of a conductor 43 (not shown) can be received in the insulation crimp 17.

The crimp contact is shown in a crimped state 37 in FIGS. 3 and 4. In FIG. 4, in the crimped state 37, the crimp base 23, the crimp sections 15 and the wings 13 are shown, sectioned through the front protection crimp 21 of the crimp contact 1. Since no conductor 43 is disposed in the area of the front protection crimp 21, the crimp sections 15 and the wings 13 are rolled together such that they seal the crimp interior 41. Gaps 51 may remain when the front protection crimp 21 and the wings 13 are crimped.

As shown in FIG. 3, sectioned through the conductor crimp 19 in the crimped state 37, the crimp sections 15 extend from the crimp base 23 substantially perpendicular in a z-direction, and are curved towards one another, abutting in a striking region 39. The crimp base 23 and the crimp sections 15 enclose a crimp interior 41 in which is situated the conductor 43. In the embodiment shown in FIG. 3, the conductor 43 comprises twenty-three single strands 45. The crimp interior 41 is formed by the receptacle 24 during crimping.

If such a crimp contact 1 is used to electrically contact an aluminum conductor 43, then on the aluminum's surfaces exposed to the outer air there is situated an electrically isolating layer of aluminum oxide, with the layer of aluminum oxide having to be pierced through in order to electrically contact the single strand 45 located under the layer of aluminum oxide. A disadvantage of a crimp connection 4 of the prior art becomes clear from FIG. 3. Inner strands 45*a* are only in mechanical and electrical contact with other single strands 45, but not with the crimp sections 15 or the crimp base 23. The inner strands 45*a* are not subjected to any sufficiently great mechanical contacting, meaning that the layer of aluminum oxide on the inner strands 45*a* cannot be pierced through. Electrical conduction via the inner strands 45*a* is thus impaired and conductivity of the aluminum conductor 43 is lowered.

SUMMARY

An object of the invention, among others, is to provide a crimp contact which shields the exposed end of an aluminum conductor while directly contacting single strands in the interior of the aluminum conductor. The disclosed crimp contact has a receptacle extending in a longitudinal direction up to a receptacle end, a crimp section extending along the receptacle and beyond the receptacle end to a front end, and a wing extending from the crimp section between the receptacle end and the front end transversely to the longitudinal direction, the wing having a conductor displacing member overlapping the receptacle in the longitudinal direction. The receptacle receives a conductor in the longitudinal direction. The crimp section encloses the conductor subsequent to crimping.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
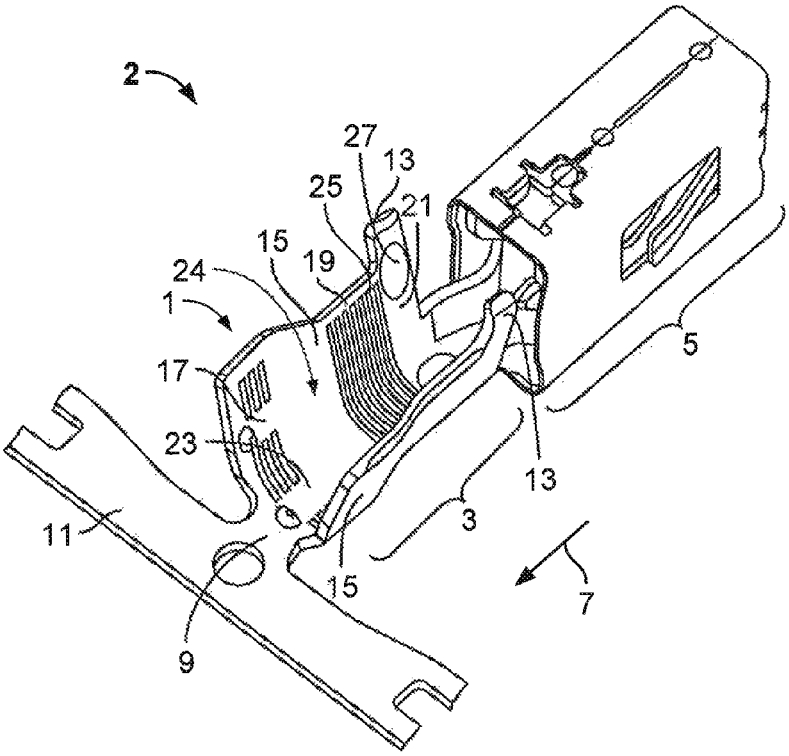
Prior Art Fig. 1
FIG. 1 is a perspective view of a crimp contact according to the prior art.
Figure 2:
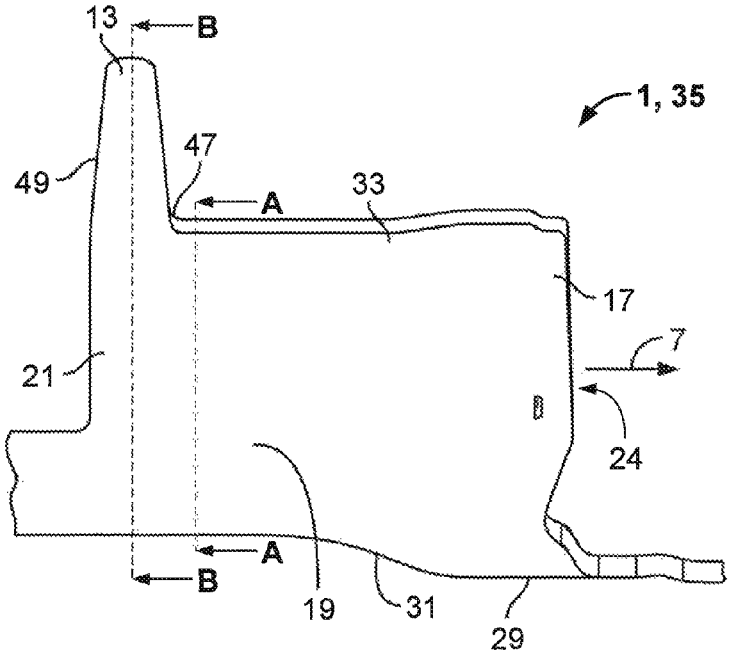
Prior Art Fig. 2
FIG. 2 is a side view of the crimp contact of FIG. 1.
Figure 3:
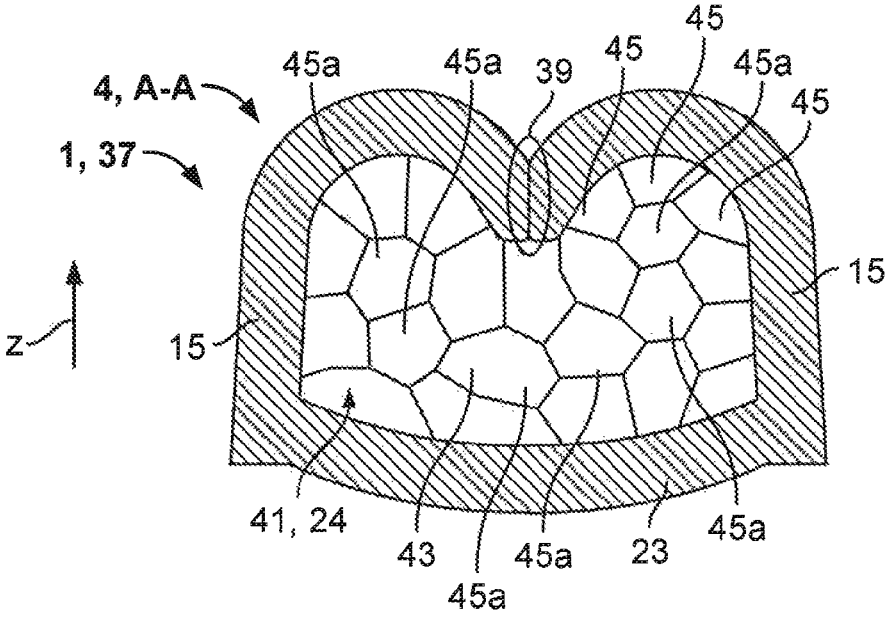
Prior Art Fig. 3
FIG. 3 is a sectional view of the crimp contact taken along line A-A of FIG. 2.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

Figure 5:
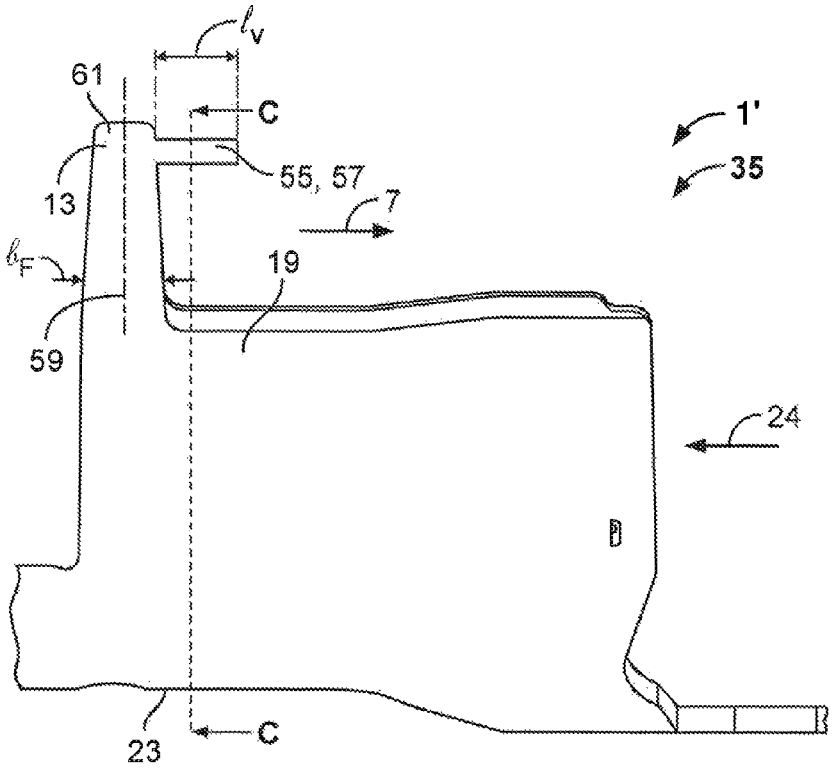
FIG. 5 is a side view of a crimp contact according to the invention.

A crimp contact 1' according to the invention is shown in FIG. 5. The crimp contact 1' has a conductor displacing member 55 formed as a displacing barb 57. The displacing barb 57 extends in a longitudinal direction 7 away from wing 13 in a direction toward the conductor crimp 19. The wing 13 shown in FIG. 5 has a width bF and is tapered such that a base 59 of the wing 13 is wider than an end 61 of the wing 13.

In the shown embodiment, the displacing barb 57 is approximately parallel to the crimp base 23, is formed substantially rectangularly, and has a length lv. The displacing barb 57 may alternatively taper in the longitudinal direction 7. The displacing barb 57 may be substantially triangular, being rounded at both its tip and the opposite end connected to the wing 13.

Figure 6:
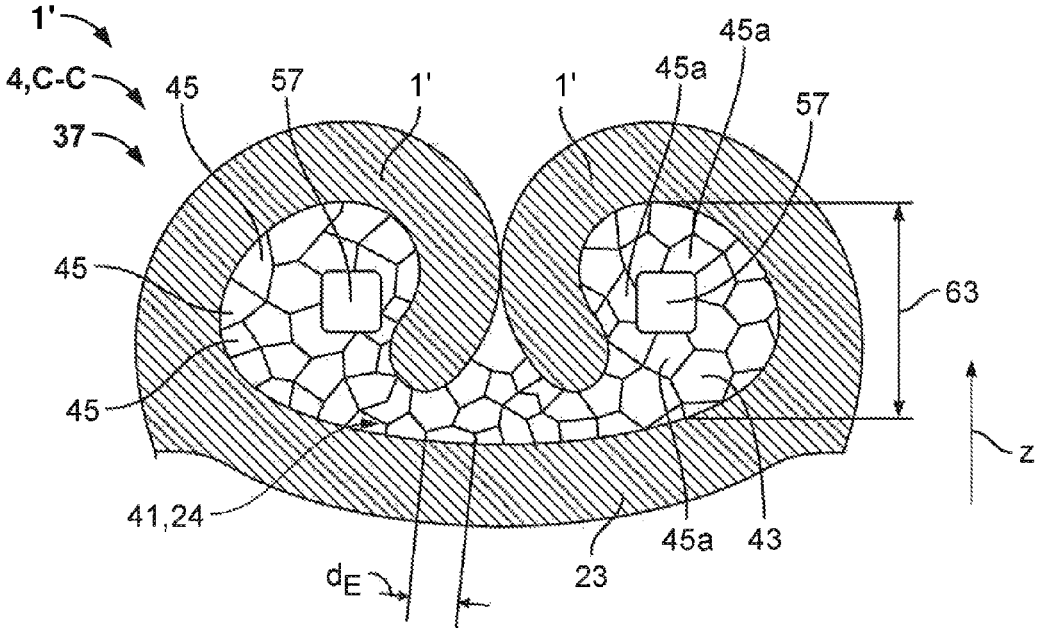
FIG. 6 is a sectional view of the crimp contact taken along line C-C of FIG. 5.

The crimp contact 1' according to the invention is shown in a crimped state 37 in FIG. 6. The crimp base 23, the crimp sections 15 and the two displacing barbs 57 provided at the wings 13 are shown in FIG. 6 as sectioned through the conductor crimp 19. Due to the arrangement of the displacing barbs 57 at the end 61 of the wings 13, both displacing barbs 57, seen in the z-direction, are arranged substantially in the center of the crimp interior 41 after crimping. Alongside the strands 45 which touch the crimp base 23 or the crimp sections 15, the displacing barbs 67 electrically contact the inner strands 45*a* of the conductor 43. An individual displacing barb 57 arranged at the end 61 of one wing 13 may be used if the strands 45 have a diameter dE which does not exceed approximately 25% of a height 63 of the crimp interior 41.

In the embodiment shown in FIG. 6, the number of strands 45 shown is merely exemplary, and the number of strands 45 can vary. Furthermore, the extent of extension of the crimp sections 15 into the crimp interior 41 shown in FIG. 6 is purely by way of example and may vary among various applications.

Figure 4:
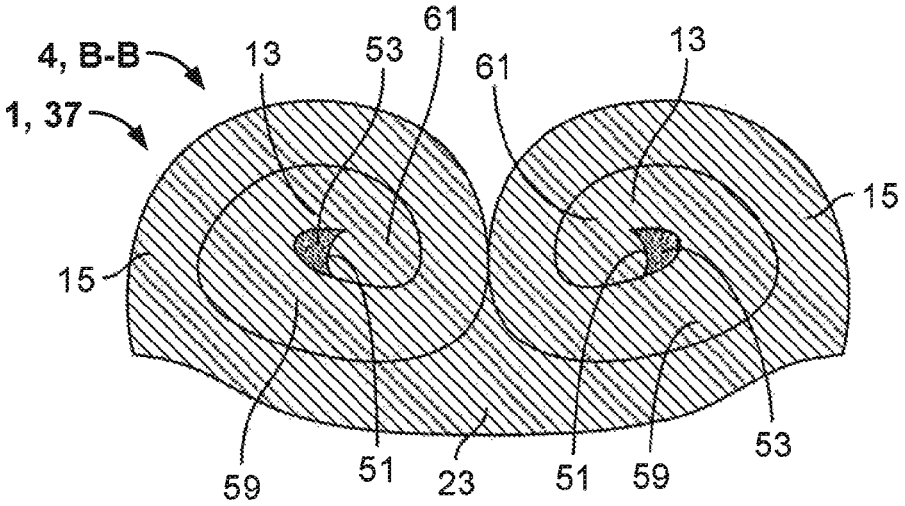
Fig. 4 Prior Art
FIG. 4 is a sectional view of the crimp contact taken along line B-B of FIG. 2.

In the front protection crimp 21 of the crimp contact 1', as similarly shown in FIG. 4, a sealing agent 53 is used. The sealing agent 53 may be made available by sealing agent repositories 27, filling the gaps 51 during crimping so that no corrosive liquids and/or ambient air can get into the crimp interior 41. The sealing agent 53 may also be provided in the receptacle 24, between the front end 49 and a receptacle end 47 of the crimp contact 1', or in the region of a conductor crimp 19. The sealing agent 53 may be a grease. The sealing agent 53 may thus be disposed in the insulation crimp 17, at the crimp sections 15, and at the wing 13 so that neither electrically conductive or corrosive liquids nor ambient air can penetrate into a crimp interior 41.

Figure 7:
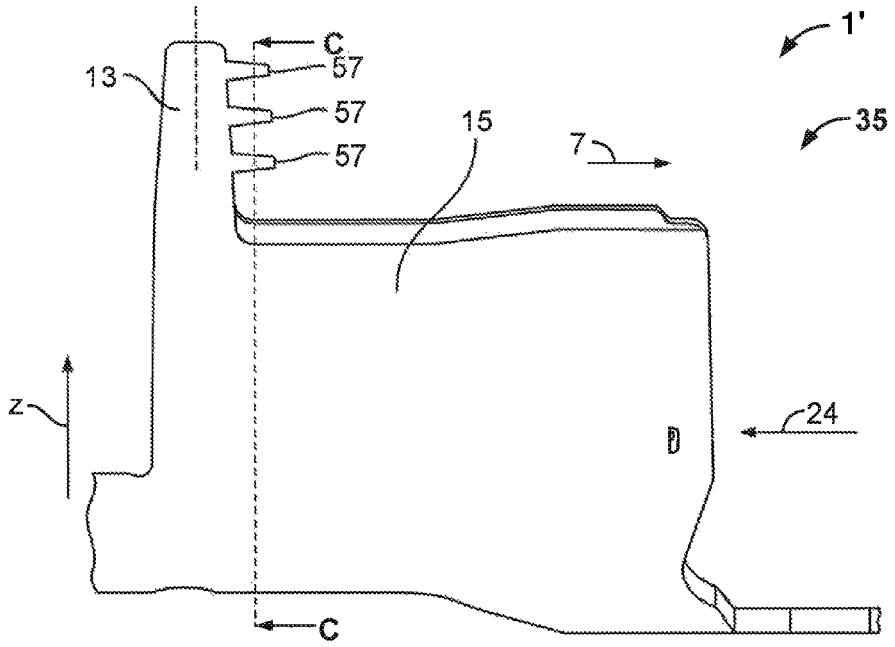
FIG. 7 is a side view of another crimp contact according to the invention.
Figure 8:
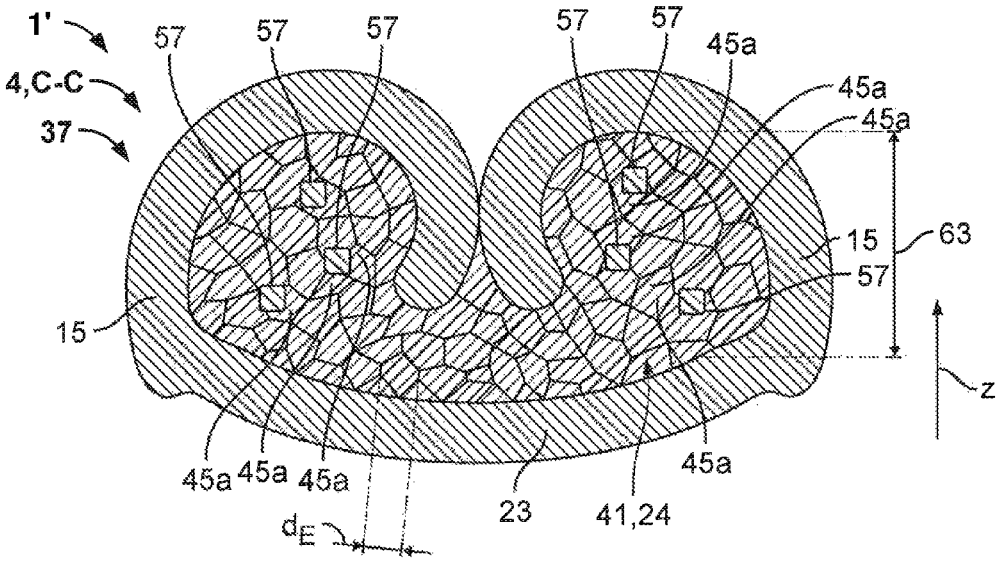
FIG. 8 is a sectional view of the crimp contact taken along line C-C of FIG. 7.

A crimp contact 1' according to another embodiment of the invention is shown in FIGS. 7 and 8. The crimp contact 1' is shown in a pre-crimped state 35 in FIG. 7. The crimp contact 1' has three displacing barbs 57 which are distributed in the z-direction along the wings 13, extending substantially parallel to the crimp base 23 and protruding from the wings 13 in a longitudinal direction 7. In the shown embodiment, the displacing barbs 57 are arranged equidistant to one another along the wings 13. The distance of the displacing barbs 57 to one another and the distance relative to the crimp sections 15 can vary depending on the configuration of the crimp contact 1. In all embodiments having a plurality of displacing barbs 57, the displacing barbs 57 can be formed identically or with various shapes.

The crimp connection 4 of the crimp contact 1' in a crimped stated 37 is shown in FIG. 8. The displacing barbs 57, at various positions in the crimp interior 41, create mechanical and electrical contact with the inner strands 45*a*. In an embodiment, all strands 45 of the conductor 43 are mechanically and electrically contacted by the crimp base 23, the crimp sections 15 or the displacing barbs 57. The plurality of displacing barbs 57 may be used when the strands 45 have a diameter dE smaller than approximately 25% of the height 63 of the crimp interior 41.

In FIGS. 9-13, a crimp contact 1' according to the invention is shown in various embodiments in a stamped-out state 65. The figures show a part of the linking bar 9, the front protection crimp 21, the conductor crimp 19, the transition region 33 and a portion of the insulation crimps 17. The crimp base 23 is indicated by a dashed line. A side of the crimp contact 1' visible in the figures is a conductor-receiving side 66. The conductor-receiving side 66 points, in the pre-crimped state 35, into the receptacle 24 and, in the crimped state 37, into the crimp interior 41. The wings 13 and the variously formed conductor displacing members 55 are also shown. The crimp sections 15 are in each case situated to the left and right respectively of the crimp base 23 and extend from the insulation crimp 17 up to the front protection crimp 21.

Serrations 25 and end markings 67 situated in the conductor crimp 19 of each crimp contact 1' in FIGS. 9-13 are also shown. The end markings 67 are two-part in the shown embodiments of the crimp contact, but in other embodiments can be formed as one part and extend from the left crimp section 15 over the crimp base 23 to the right crimp section 15. The end markings 67 are surface structures which are oriented substantially perpendicular to the longitudinal direction 7 and which can, for example, be embossed. The end markings 67 indicate to the user up to where the stripped end of the conductor 43 must be pushed, counter to the longitudinal direction 7, into the crimp sleeve 3 which is created by bending the two crimp sections 15 up out of the plane of projection. The end markings 67 are thus situated between the front protection crimp 21 and the conductor crimp 19. The end markings 67 may protrude from the crimp contact 1' perpendicularly to the longitudinal direction 7 so that this region represents a mechanical stop point for that end of the aluminum conductor 43. In such a configuration, the user can thus displace the aluminum conductor 43 to in the longitudinal direction 7 until the aluminum conductor 43 strikes the end markings 67 and thus signals to the user via a haptic feedback that the aluminum conductor 43 is correctly inserted into the crimp contact 1'.

Figure 9:
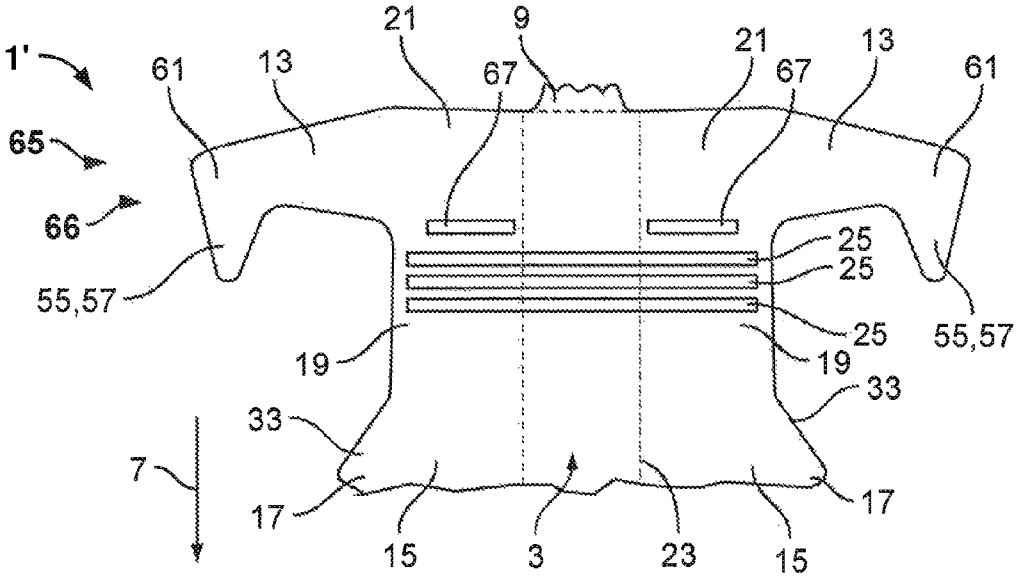
FIG. 9 is a top view of another crimp contact according to the invention in a stamped-out state.

The embodiment of the crimp contact 1' shown in FIG. 9 has, at the ends 61 of the wings 13, conductor displacing members 55 formed as displacing barbs 57. These displacing barbs 57 each directly adjoin the end 61 of the wing 13, i.e. in contrast to the displacing barbs 57 shown in FIG. 5 they are not at a distance from the end 61 of the wing 13.

Figure 10:
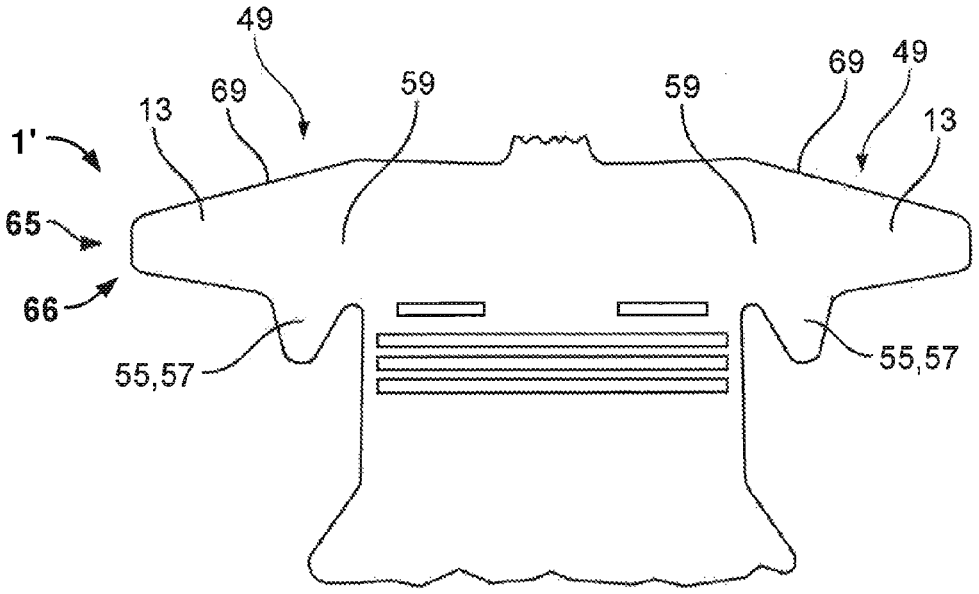
FIG. 10 is a top view of another crimp contact according to the invention in a stamped-out state.

The embodiment of the crimp contact 1' shown in FIG. 10 has displacing barbs 57 each formed at the base 59 of a wing 13. It can also be seen that the wings 13 have an incline 69 at the front end 49 of the crimp contact 1'. With the shown incline 69, it can be ensured that the wing 13 is rolled up towards the base 59 starting with the end 61.

Figure 11:
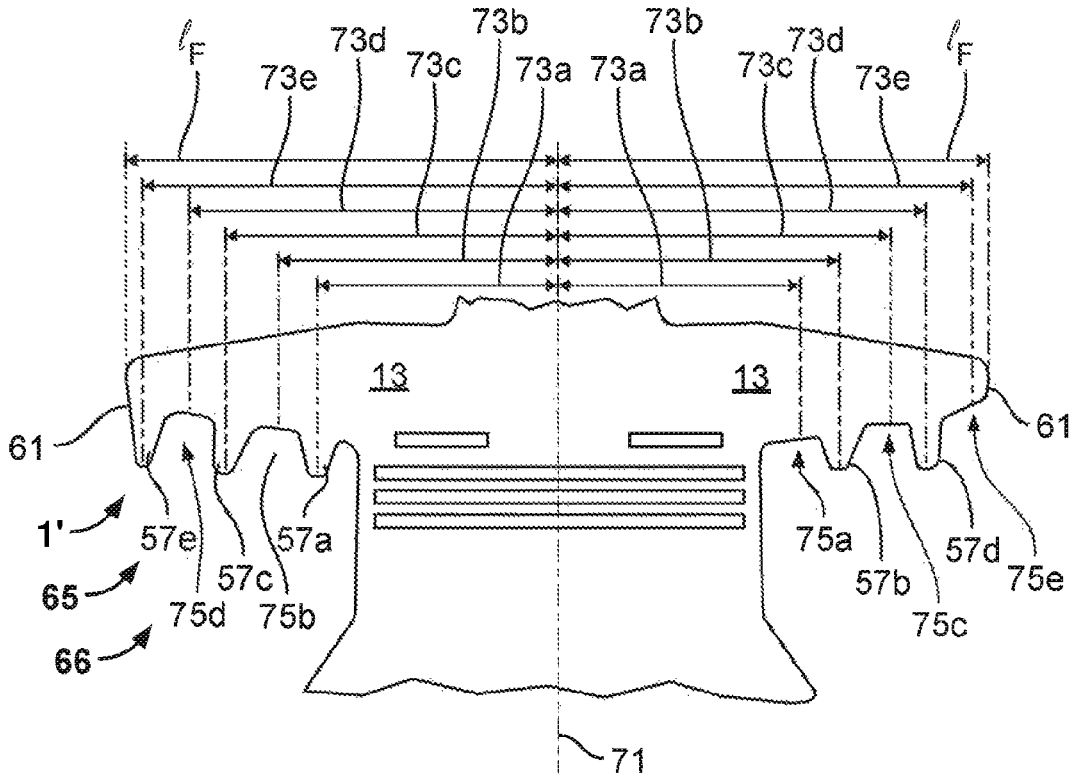
FIG. 11 is a top view of another crimp contact according to the invention in a stamped-out state.

The embodiment of the crimp contact 1' shown in FIG. 11 has symmetrical wings 13 and displacing barbs 57 arranged antisymmetrically on these wings 13. The ends 61 of the wings 13 are in each case at a distance 1F from a center axis 71 of the crimp contact 1'. A first displacing barb 57*a* is situated at the distance 73*a* from the center axis 71, with a gap 75*a* being situated at the same distance 73*a* on the opposite wing 13. A second gap 75*b* which is situated at a distance 73*b* from the center axis 71 adjoins the first displacing barb 57*a* at the left wing 13. At the same distance 73*b* a second displacing barb 57*b* is situated on the right wing 13. At a distance 73*c*, a third displacing barb 57*c* is situated on the left wing 13 and a third gap 75*c* is situated on the right wing 13. At a distance 73*d*, there are situated a fourth gap 75*d* on the left wing 13 and a fourth displacing barb 57*d* on the right wing 13. A fifth displacing barb 57*e* adjoins the fourth gap 45*d* of the left wing 13 at a distance of 73*e* relative to the center axis 71. At the right wing 13, adjoining the fourth displacing barb 57*d*, a fifth gap 75*e* is arranged at a distance of 73*e* relative to the center axis 71. The displacing barbs 57*a*-57*e* and the gaps 75*a*-75*e* are thus arranged antisymmetrically relative to the center axis 71, the distances being measured relative to the center axis 71.

Figure 12:
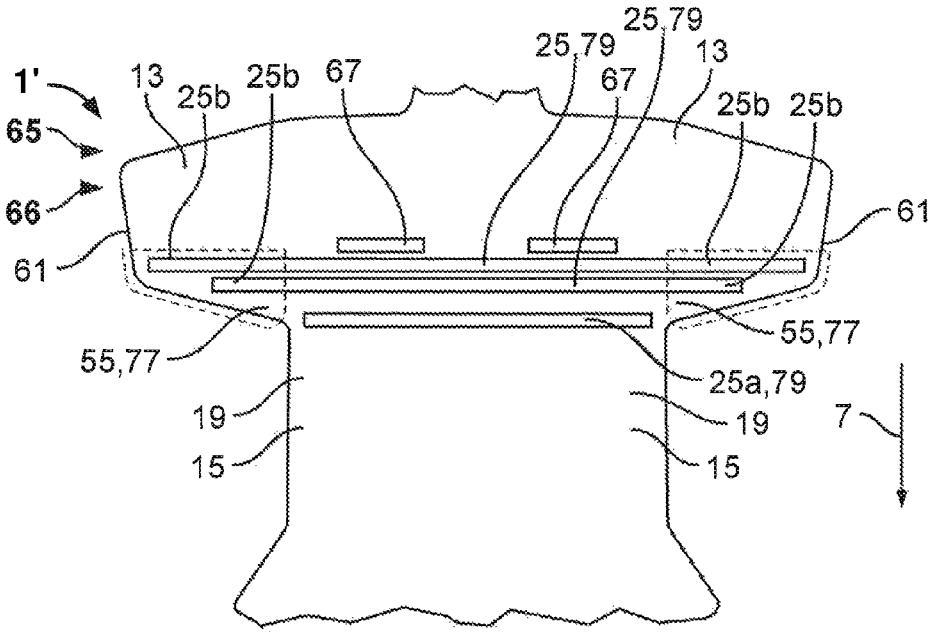
FIG. 12 is a top view of another crimp contact according to the invention in a stamped-out state.
Figure 13:
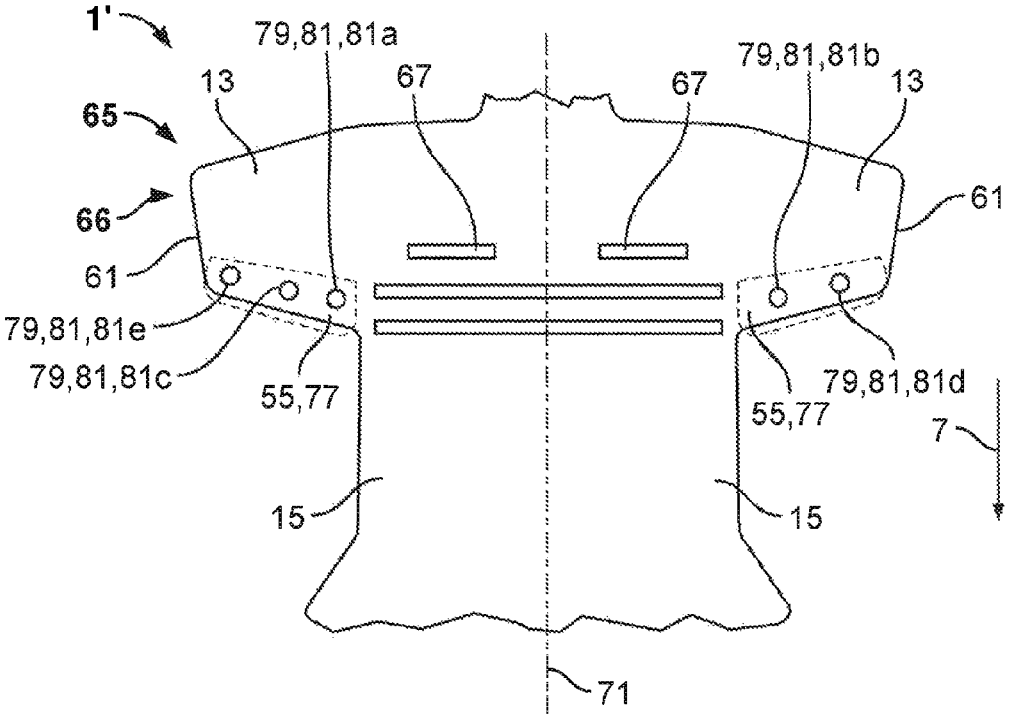
FIG. 13 is a top view of another crimp contact according to the invention in a stamped-out state.

In the embodiments of the crimp contact 1' shown in FIGS. 12 and 13, the conductor displacing member 55 is present in each case in the form of a widened base 77 of the wing 13. Counter to the longitudinal direction 7, the wing 13, at the height of the end markings 67, directly adjoins in each case the widened bases 77. The widened bases 77 shown in FIGS. 12 and 13 in each case extend in a tapering manner from the crimp sections 15 up to the ends 61 of the wings 13.

As shown in the embodiment of FIG. 12, the crimp contact 1' has serrations 25 which extend from a widened base 77 to the opposite widened base 77. The serrations 25 pierce through an oxide layer 79. In this case, the serration 25*a* formed in the conductor crimp 19 in FIG. 12 is the element for breaking through an oxide layer 79, with which the oxide layers of the outwardly situated single strands 45 are pierced through, while the regions of the serrations 25*b* of the widened bases 77 are curved during crimping between the strands 45 and thus pierce the oxide layers of the inner strands 45*a*. After the oxide layers 79 are pierced through, an electrical contact is created between the crimp contact 1 and the conductor 43 by the widened bases 77 located between the inner strands 45*a*. The serrations 25 shown in FIG. 12 are continuous in the embodiment shown, but may consist of several sections in other embodiments.

As shown in the embodiment of FIG. 13, the crimp contact 1' also has widened bases 77 of the wings 13 as conductor displacing members 55. In contrast to the configuration of the crimp contact 1' shown in FIG. 12, the crimp contact 1' shown in FIG. 13 has no serrations 25 in the region of the widened bases 77, but rather has bores 81 which are used as elements for piercing through an oxide layer 79. The bores 81 may only partially extend into the crimp contact 1 or can be fully bored through it. It can also be seen that the bores 81 on the symmetrically arranged wings 13 are arranged antisymmetrically. The bores 81*a*-81*e* are positioned in increasing distance from the center axis 71. The bores 81 and the gaps 75 thereof are consequently, like the displacing barbs 57 and gaps 75 of FIG. 11, arranged alternatingly and antisymetrically.

What is claimed is:

1. A crimp contact, comprising:

a receptacle extending in a longitudinal direction up to a receptacle end, the receptacle receiving a conductor in the longitudinal direction, the conductor inserted into the receptacle only up to the receptacle end;

a crimp section having a conductor crimp extending along the receptacle in the longitudinal direction up to the receptacle end and a front protection crimp extending from the conductor crimp between the receptacle end and a front end in the longitudinal direction, the conductor crimp enclosing the conductor subsequent to crimping; and a wing extending from the front protection crimp transversely to the longitudinal direction, the wing having a conductor displacing member overlapping the receptacle in the longitudinal direction, the conductor displacing member in mechanical and electrical contacts with the conductor.

2. The crimp contact of claim 1, wherein the conductor displacing member is a base of the wing.

3. The crimp contact of claim 2, wherein the base widens in a direction toward the receptacle.

4. The crimp contact of claim 1, wherein the conductor displacing member is formed as a displacing barb.

5. The crimp contact of claim 4, wherein the displacing barb is disposed on the wing at a distance from the crimp section and extends from the wing in a direction away from the front end.

6. The crimp contact of claim 4, wherein the displacing barb is disposed on an end of the wing opposite the crimp section.

7. The crimp contact of claim 4, wherein the displacing barb is disposed on an end of the wing adjacent the crimp section.

8. The crimp contact of claim 4, wherein the wing has a plurality of displacing barbs distributed along the wing in a direction perpendicular to the longitudinal direction.

9. The crimp contact of claim 8, further comprising a pair of wings disposed symmetrically to each other.

10. The crimp contact of claim 9, wherein the plurality of displacing barbs are disposed antisymmetrically relative to one another along the pair of wings.

11. The crimp contact of claim 1, further comprising a pair of crimp sections disposed on opposite sides of the crimp contact.

12. The crimp contact of claim 11, wherein the receptacle end has an end marking disposed on a crimp base between the pair of crimp sections.

13. The crimp contact of claim 1, wherein the conductor displacing member pierces an oxide layer.

14. The crimp contact of claim 1, further comprising a sealing agent repository providing a sealing agent during crimping.

15. The crimp contact of claim 1, wherein the conductor displacing member extends in the longitudinal direction from the wing toward the conductor crimp and beyond the receptacle end.

16. The crimp contact of claim 1, wherein the front protection crimp and the wing are rolled together to enclose the receptacle end of the receptacle subsequent to crimping.

17. The crimp contact of claim 16, wherein the conductor displacing member extends into an end of the conductor positioned at the receptacle end subsequent to crimping.

18. The crimp contact of claim 1, wherein the wing extends beyond the conductor crimp in a direction perpendicular to the longitudinal direction.

19. A crimp connection, comprising:

a conductor; and a crimp contact having a receptacle extending in a longitudinal direction up to a receptacle end and receiving the conductor in a longitudinal direction, the conductor inserted into the receptacle only up to the receptacle end, a crimp section having a conductor crimp extending along the receptacle in the longitudinal direction up to the receptacle end and crimped around the conductor and a front protection crimp extending between the receptacle end and a front end in the longitudinal direction, and a wing extending from the front protection crimp transversely to the longitudinal direction, the wing having a conductor displacing member overlapping the receptacle in the longitudinal direction and extending into an end and electrical contacting with the conductor.

20. The crimp connection of claim 19, wherein an insulation crimp receiving a conductor insulation of the conductor is disposed at an end of the crimp contact opposite the wing.

21. The crimp connection of claim 19, further comprising a sealing agent deformed during crimping and filling gaps in at least one of the crimped wing at the front end, the crimped insulation crimp, and the crimped crimp section.

* * * * *